US005955994A

United States Patent [19]

Staker et al.

[11] Patent Number: 5,955,994

[45] Date of Patent: Sep. 21, 1999

[54] MICROSTRIP ANTENNA

[75] Inventors: Mark R Staker, Ipswich; John C Mackichan, Felixstowe; Jashwant S Dahele, Swindon, all of United Kingdom

[73] Assignee: British Telecommunications public limited company, London, United Kingdom

[21] Appl. No.: 08/051,797

[22] Filed: Apr. 26, 1993

Related U.S. Application Data

[63] Continuation of application No. 07/566,412, Aug. 21, 1990, abandoned.

[30] Foreign Application Priority Data

Feb. 15, 1988 [GB] United Kingdom ..... 8803451
Feb. 13, 1989 [WO] WIPO ..... PCT/GB89/00141

[51] Int. Cl.[6] ..... H01Q 1/38
[52] U.S. Cl. ..... 343/700 MS
[58] Field of Search ..... 343/700 MS; H01Q 1/38, H01Q 13/08, 21/06

[56] References Cited

U.S. PATENT DOCUMENTS

| | | | |
|---|---|---|---|
| 4,370,657 | 1/1983 | Kaloi | 343/700 MS |
| 4,415,900 | 11/1983 | Kaloi | 343/700 MS |
| 4,761,654 | 8/1988 | Zaghloul | 343/700 MS |
| 4,812,855 | 3/1989 | Coe et al. | 343/700 MS |
| 4,847,625 | 7/1989 | Dietrich et al. | 343/700 MS |

FOREIGN PATENT DOCUMENTS

| | | | |
|---|---|---|---|
| 154858 | 2/1985 | European Pat. Off. | 343/700 MS |
| 188106 | 11/1982 | Japan | 343/700 MS |
| 2067842 | 7/1981 | United Kingdom | 343/700 MS |

OTHER PUBLICATIONS

Patent Abstracts of Japan, vol. 8, No. 99, E243, abstract of JP 59–16402, pub 1984–01–27 Nippon Denshin Denwa Kosha.

*Electronics Letters*, Jul. 30, 1987, vol. 23, No. 16, pp. 835–837, Lee et al: "Radiation Characteristics of Microstrip Arrays With Parasitic Elements".

*Electronics Letters*, Oct. 25, 1984, vol. 20, No. 22, pp. 931–933, Entschladen et al: "Microstrip Patch Array Antenna".

Lee et al: "Microstrip Antenna Array Wit Parasitic Elements," pp. 795–797.

*Primary Examiner*—Michael C. Wimer
*Attorney, Agent, or Firm*—Nixon & Vanderhye P.C.

[57] ABSTRACT

A patch array microwave antenna comprising spaced sub-arrays each consisting of a patch and at least a pair of parasitic patches fed from the non-radiating edges of the fed patch. In a second embodiment a second pair of parasitic patches fed from the radiating edges are also provided so as to form a five-member cross. Spacings between patches in a group are kept to below λ/15, and groups spaced apart by at least double this. Intergroup distances P are kept below 2λ, but may be greater than λ if alternate lines of patches are staggered by P/2 so no on-axis diffraction lobes appear in the radiation pattern.

25 Claims, 2 Drawing Sheets

MICROSTRIP ANTENNA

This is a continuation of application Ser. No. 07/566,412, filed Aug. 21, 1990, now abandoned.

This invention relates to microstrip antennas comprising a plurality of patches on a substrate.

Microstrip patch antennas are resonant radiating structures which can be printed on circuit boards. By feeding a number of these elements arranged on a planar surface, in such a way that their excitations are all in phase, a reasonably high gain antenna can be obtained that occupies a very small volume by virtue of being flat. Microstrip antennas do have some limitations however that reduce their practical usefulness.

1) Microstrip patches are resonant structures with a small bandwidth of operation, typically 2.5–5%. Communication bandwidths are usually larger than this. Satellite receive antennas for instance should ideally work from 10.7–12.75 GHz, which requires a bandwidth of 17.5%.
2) The patches in isolation have low gain, typically 6–8 dBi. This leads to a large number of elements being needed to produce useful gains. A satellite receive antenna for instance should have a gain of around 40 dBi, implying the use of thousands of elements. However, the loss in the power splitting networks required to feed the elements increases as the array increases in size so leading to an upper limit in achievable gain.

It is known to improve the bandwidth of a rectangular patch by adding, in proximity thereto, further patches which are fed parasitically therefrom (as for example in British Patent 2067842). In that patent, the edges of the parasitic patches are capacitatively coupled to the radiative edges of the fed patch. The mechanisms by which such parasitic patches are excited have not hitherto been well understood or described, however, so it has not proved possible to design optimum performance antennas comprising an array of patches of which some are parasitically fed.

In particular, one proposal has been to fabricate arrays of spaced patches, only some of which are fed using a constant inter-patch spacing.

According to the invention, there is provided an antenna comprising a plurality of substantially rectangular patches energisable at a resonant frequency each having an opposed pair of first edges and an opposed pair of second edges corresponding in length to the resonant frequency, disposed upon a substrate, characterised in that the patches are so arranged as to form a plurality of elemental groups, each such group comprising a first patch adapted to be fed from a feed line and a pair of second patches each adjacent to and spaced from one of the second edges of the first patch, the second patches being adapted to be fed only parasitically from the first, the groups being spaced apart on the substrate in an array, such that the spacing between patches of adjacent groups substantially exceeds the spacing between patches within a group.

In another aspect, the invention provides an antenna comprising a plurality of elemental groups disposed in an array upon a substrate, each group comprising a central patch adapted to be fed from a feed line and four parasitic patches adapted to be parasitically fed from the central patch, disposed around the central patch so as to form a cross, wherein the elemental groups are arranged with their cross axes parallel one to another, the array comprising a plurality of lines of groups spaced along the line by a distance P less than twice the wavelength $\lambda$ corresponding to the resonant frequency of the antenna, alternate lines being displaced by P/2 so that the effective spacing in at least one antenna plane is less than $\lambda$.

Preferably, a feed network comprising a plurality of feed lines is disposed upon one face of a second substrate, aligned parallel with the first so that a feed line lies adjacent a feed point of each central patch, and there is provided between the two substrates a ground plane, including apertures between each such feed point and the adjacent feedline, so as to allow the porch to be fed therefrom.

Other preferred embodiments of the inventions are as recited in the claims appended hereto.

The invention will now be described by way of example only, with reference to the accompanying drawings, in which.

Figure 1:
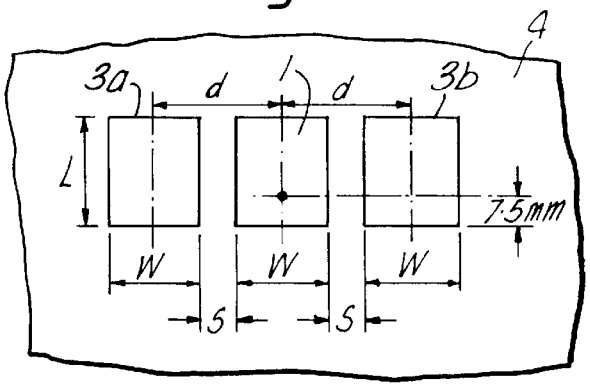
FIG. 1 is a front elevation of a sub-array group forming part of an antenna according to a first embodiment of the invention.

Referring to FIG. 1, a sub-array group for use in a microstrip array antenna comprises a central, fed, rectangular patch 1 having a pair of edges of resonant length L chosen, in known manner, to be $L=\lambda/2\epsilon_r$ (where $\lambda$ in the following is 64.82 mm) flanked at either of these edges by a pair of identical parasitic patches 3*a*, 3*b*, all upon a substrate layer 4.

Figure 2:
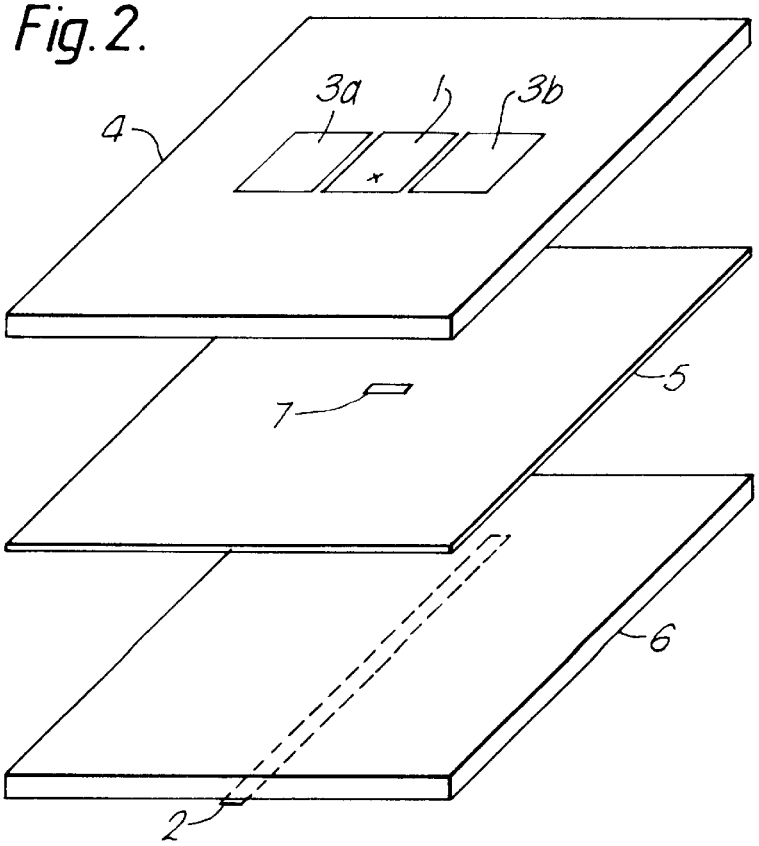
FIG. 2 is an exploded isometric view showing a cross section through the antenna of FIG. 1.

Referring to FIG. 2, one preferred method of feeding the central patch 1 is to provide, under the ground plane layer 5, a second substrate layer 6 (which may be of the same material as the first layer 4) upon the outer side of which the feed line 2 for that patch is printed, forming a combining network with the feedlines of neighbouring patches. The ground plane layer 5 is traversed by a coupling slot or aperture 7 between the feeding point of the fed patch 1 and the feed line 2, so as to allow the patch 1 to couple to the feed line 2.

In the following, the first, resonant-length, edges (L) will be referred to as 'non-radiative edges', and the second pair of edges (W) as 'radiative edges', for convenience.

Experimental evidence shows that, in this arrangement, a) parasitic excitation is proportional to patch width w. Thus, for maximum parasitic excitation, the width w of all patches must be made large. It cannot, however, be made equal to the resonant length L or else the non-radiative edges will start to radiate and give rise to unwanted cross-polar radiation so, for a bandwidth of, say 10% the width (W) must not be within 95–105% of the resonant length L.
b) parasitic excitation is, to a good approximation, an exponential decay function of catch separation. For high excitation, therefore, patch separations should be kept low.
c) parasitic phase is a function of patch separation. For large separations, above about 0.08 $\lambda$ (in this case, 5 mm), the phase difference between the central and parasitic patches is proportional to separation; below this the phase difference is always greater than this relation would predict.

From these results a simple expression for parasitic element excitation was derived, having the form:

$$\text{Excitation}=awe^{bs+jcd}$$

where w, s and d are parasitic patch width, separation of parasitic patch edge from fed patch edge, and separation of patch centres respectively. Using derived a, b and c values any H-plane parasitically coupled linear array can be modelled. In a first example, a sub-array is formed from 3 elements having a resonant length L of 20 mm, each 18.5 mm (w=0.925L) wide and with a separation of 2 mm on a 1.57 mm thick PTFE substrate layer 4 having a relative permittivity $\epsilon_r$ equal to 2.22. Its predicted directivity was 9.43 dB; the subsequent measured result showed a directivity of 9.33 dB. A second example has 14 mm wide patches (w=0.70L), where the separation is 3 mm; again, agreement between prediction and measurement is good.

From the foregoing, the criteria disclosed herein governing the choice of patch separation lead to the choice of a small patch separation relative to the operating wavelength used. The criteria governing inter-element spacing of a microstrip array are related to the wavelength rather differently, however, and favour inter-element distances of on the order of and below, λ. It has been found that providing further parasitic patches beyond those flanking the fed patch is counterproductive and severely reduces the antenna performance, so it is important that the edge to edge spacing between parasitic patches of adjacent sub-arrays is significantly greater than interpatch spacing within each sub-array.

Figure 3:
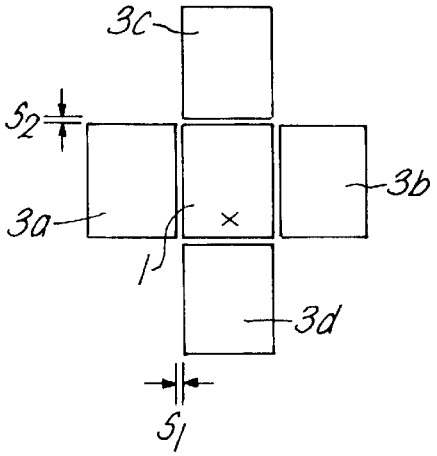
FIG. 3 shows a sub-array group forming part of an antenna according to a second embodiment of the invention.

It is also possible to parasitically excite patches from the radiative edges of a fed patch. The coupling mechanism here is different, however (apparently, predominantly reactive), and in general is very much more sensitive to the interpatch separation. It is found that adding parasitic patches at the non-radiative edges stabilises this sensitivity, however, so that practical antennas can be formed in the cross configuration shown in FIG. 3 with a pair of parasitic patches 3*c*, 3*d* at the radiative edges of fed patch 1, (with interpatch separation $S_2$) and a pair of patches 3*a*, 3*b* at the non-radiative edges thereof (with interpatch separation $S_1$). The five-element cross has a larger effective area than the three-element subarray, and hence a better gain and bandwidth.

Since the sub-arrays occupy a large area, it would be difficult to provide a feed network on the same surface of the substrate, so the feed mechanism for the fed patches in this case is preferably that of FIG. 2, with the feed network 2 printed on the other side of a second substrate layer 6 coupled to the fed patches 1 via slots 7 in the ground plane 5.

The spacing of the sub-arrays is not straightforward, but is governed by several criteria. On one hand, as is stated above, the spacing between parasitic patches of adjacent sub-arrays must be significantly greater than the spacing within the sub-arrays. On the other hand, it is desirable to keep the minimum distance between lines of the array to below λ, so as to prevent the array acting as a diffraction grating and producing 'grating lobes' in the radiation pattern. These constraints are very much in conflict, since (depending on relative permittivity of the substrate) each patch can be up to λ/2 in length, and only slightly less in width; sub-array groups of three patches can thus each be over 1.5 λ long.

Figure 4:
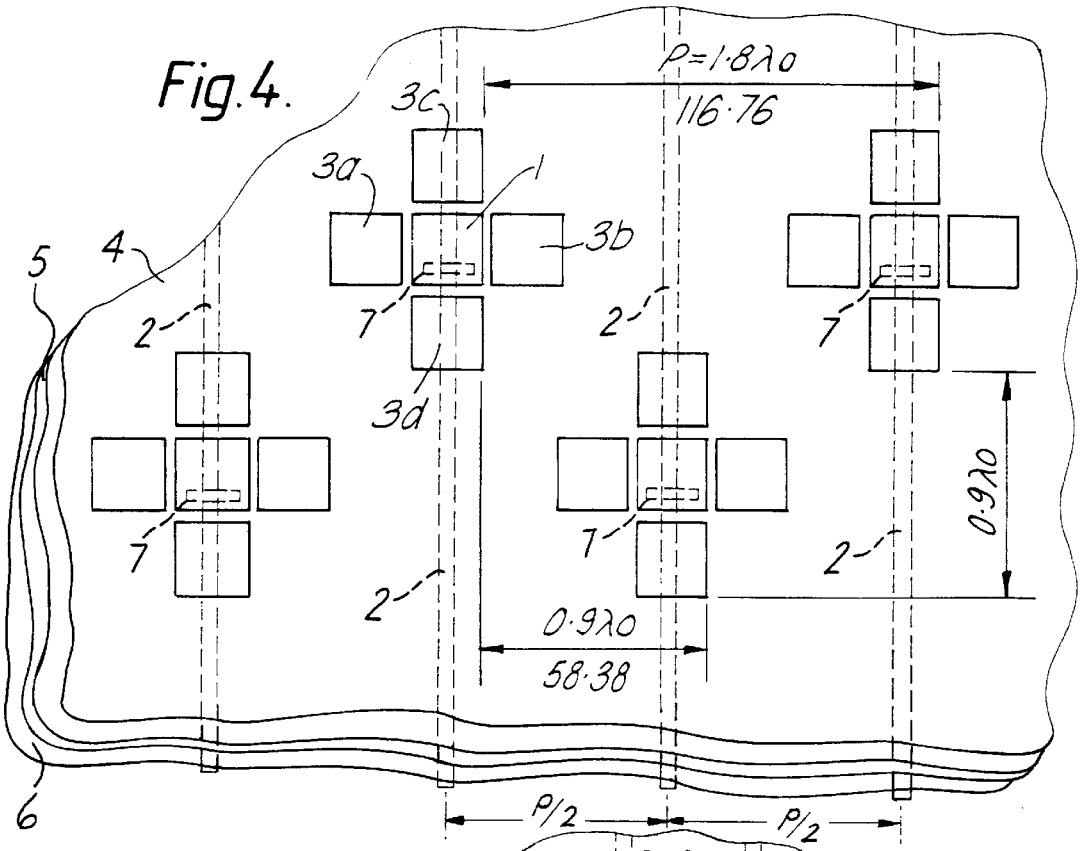
FIG. 4 shows a first array arrangement of an antenna according to the embodiment of FIG. 4.

Referring to FIG. 4, one solution is to accept the occurrence of grating lobes but ensure that they do not occur in the major planes of the antenna (ie parallel or perpendicular to its cross axes). In FIG. 4, the arrangement is a square lattice of parameter P=1.8 λ, with a motif comprising a sub-array group at the corners of the lattice cells and a sub-array group at the centres thereof; it may alternatively be regarded as a square lattice of parameter 0.9 λ with alternate cell corners vacant. Here, since the minimum distance between corresponding diagonal lines of sub-array groups is more than λ, grating lobes will appear in the radiation pattern of the antenna. But since in both major planes of the antenna the distance between adjacent lines of sub-arrays is only 0.9 λ and these lines are staggered by P/2, the grating effects cancel and no grating lobes appear in these planes; 0.9 λ is selected so as to maximise the distance apart of sub-array groups, without generating grating lobes.

Figure 5:
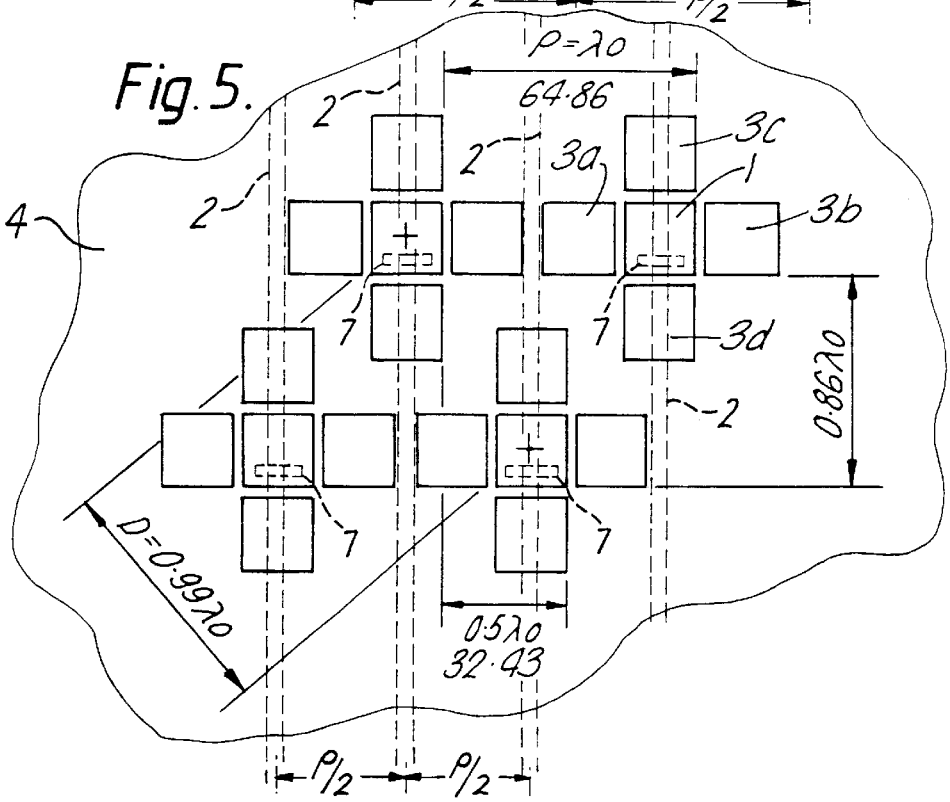
FIG. 5 shows a second array arrangement of an antenna according to the embodiment of FIG. 4.

Referring now to FIG. 5, it is possible to achieve an array giving no grating lobes, although with maximum patch width w≅93% L the spacing between parasitic patches of adjacent sub-array groups is reduced to what is effectively the minimum workable value of about 2S. This is achieved, as shown, by providing sub-arrays in lines spaced apart at P=λ (which is close to the minimum achievable), but arranging the lines in a staggered configuration so that the diagonal centre-to-centre distance between sub-arrays is just under λ and thus no grating lobes occur.

In the embodiments shown in FIGS. 4 and 5, L=20 mm, W=18.5 mm, and the substrate is 1.57 mm PTFE ($\epsilon_r$=2.22).

Antennas according to the invention thus have several advantages.

Since a single feed point is required for each parasitic sub-array rather than for each element, there is a reduction in feed complexity, and thus manufacture is simplified and power splitter loss reduced. Similarly, phase shifting and diplexing can also occur at sub-array level leading to a saving in hardware. Parasitic sub-arrays give significant improvement in directivity and bandwidth over single elements, but a drawback in the use of parasitic sub-arrays is that the directivity obtained is marginally lower than that obtained from a similar corporate fed array due to the limited amount of phase control that can be obtained from this type of parasitic coupling between microstrip radiating elements.

Hitherto, the sub-array groups have been discussed in terms of symmetrical pairs of parasitic patches (3*a*, 3*b*), (3*c*,3*d*) flanking a fed patch 1.

It is of course possible to provide instead an asymmetrical pair of patches (having different widths or separations), or even only a single parasitic patch. In this case the beam produced will be 'squinted', instead of propagating perpendicular to the patch; such antennas find application in, for example, satellite reception since a satellite will usually be at an elevation angle (30° in the UK, for example) to the horizontal whereas a printed antenna is preferably mounted flat on a wall.

In the exemplary embodiments, an antenna includes a plurality of substantially rectangular patches energisable at a resonant frequency. Each patch has an opposed pair of first edges, and an opposed pair of second edges, the second edges corresponding in length to the resonant frequency. The patches are disposed upon a common substrate. The antenna patches are so arranged as to form an array of groups, each such group having a first patch adapted to be fed from a feed line and a pair of second patches, each second patch being adjacent to and spaced from one of the second edges of the first patch. The second patches are adapted to be fed only parasitically from the first patch and the groups are spaced apart on the substrate in an array such that the spacing between patches of adjacent groups substantially exceeds the spacing between patches with a group. In some of the exemplary embodiments, each group also comprises a further pair of second patches adjacent to and spaced from the first edges of the first patch. Furthermore, in such exemplary embodiments, the spacing of the second patches of the further pair from the first edges of the first patch is different to the spacing of the second patches from the second edges of the adjacent first patch. Preferably the spacing between patches of adjacent groups is at least double the spacing between patches within a group.

In some exemplary embodiments, the spacing of the second patches from the first patch within a group does not exceed one fifteenth of the wavelength corresponding to the resonant antenna operating frequency. The spacing between the second patches and the first patch within each group preferably may be between one thirtieth and one thirty-fifth of the resonant wavelength of the antenna and the distance between corresponding points of the arrayed groups is approximately nine tenths of the operating wavelength. In yet other embodiments, the spacing of the second patches from the first patch within a group preferably does not exceed one seventeenth of the distance between corresponding points of arrayed groups. Preferably, the length of the first edges of the patches is sufficiently different to that of the second edges to avoid cross-polarization. The length of the first edges of the patches preferably maybe 90–95 percent that of the second edges. Within each group, at least one second patch preferably may have shorter first edges than at least one other second patch. With each group, one second patch adjacent a second edge of the first preferably may be spaced a shorter distance therefrom than the other, whereby the reception axis of the antenna is not perpendicular to the plane of the substrate.

One embodiment of the antenna herein described includes a plurality of elemental groups disposed in an array upon a substrate, each group having a central patch adapted to be fed from a feed line and four parasitic patches adapted to be parasitically fed from the central patch, disposed around the central patch so as to form a cross, wherein the elemental groups are arranged with their cross axes parallel one to another. The array in this embodiment includes a plurality of lines of groups spaced along the line by a distance P which is less than twice the wavelength $\lambda$ corresponding to the resonant frequency of the antenna and groups along alternate lines are displaced in location by P/2 so that the effective spacing in at least one antenna plane is less than $\lambda$. P is preferably at least equal to the resonant antenna wavelength $\lambda$ and adjacent lines are spaced apart by P/2 so that the antenna provides a square array. The diagonal distance between corresponding points in arrayed groups in adjacent lines preferably is less than the operating wavelength $\lambda$, so that the antenna does not produce diffraction grating lobes at that wavelength. A feed network having a plurality of feed lines is preferably disposed upon one face of a second substrate, parallel with the first substrate, aligned so that a feed line lies adjacent a feed point of each central, or first, patch and there is provided between the two substrates a ground plane which includes apertures between each such feed point and the adjacent feedline so as to allow the patch to be fed from the adjacent feed line.

Whilst in the foregoing the invention has been discussed in terms of a transmitter, it is of course equally applicable to receiver antennas; references to feeds and feed lines will be generally understood to include this.

We claim:

1. An antenna comprising:

a plurality of substantially rectangular patches, disposed upon a common substrate, each patch having a pair of parallel first edges of length W perpendicular to another pair of parallel second edges of length L, which dimension L defines a corresponding resonant frequency, the patches forming an array of groups, each such group comprising a first patch fed from a feed line and a pair of second patches each adjacent to and spaced from one of the second edges L of the first patch, the second patches being fed only parasitically from the first patch, the groups being spaced apart on the substrate in said array with the spacing between patches of adjacent groups exceeding the spacing between patches within a group.

2. An antenna as in claim 1 wherein each group also comprises a further pair of second patches adjacent to and spaced from the first edges W of the first patch.

3. An antenna as in claim 2 wherein the spacing of the second patches of the further pair from the first edges L of the first patch is different than the spacing of the second patches from the second edges W of the first patch.

4. An antenna as in claim 1, wherein the spacing between patches of adjacent groups is at least double the spacing between patches within a group.

5. An antenna as in claim 1, wherein the spacing of the said second patches from the said first patch within a group does not exceed one fifteenth of the resonant frequency wavelength.

6. An antenna as in claim 5, wherein the spacing between the second patches and the first patch within each group is between one thirtieth and one thirty-fifth of the resonant frequency wavelength and the distance between the centers of groups of the array is approximately nine tenths of the said wavelength.

7. An antenna as in claim 1 wherein the spacing of the second patches from the first patch within a group does not exceed one seventeenth of the distance between the centers of groups in the array.

8. An antenna as in claim 1, in which the length of the first edges W of the patches is different from that of the second edges L to avoid cross-polarization.

9. An antenna as in claim 8, in which the length of the first edges W of the patches is 90–95 percent that of the second edges L.

10. An antenna as in claim 1, in which, within each group, at least one second patch has shorter first edges W than does at least one other second patch.

11. An antenna as in claim 1, in which, within each group, one second patch adjacent a second edge L of the first patch is spaced a shorter distance therefrom than is the other second patch.

12. An antenna comprising:

a plurality of elemental groups disposed in an array upon a first substrate, each group having a transmission line fed central patch and four parasitic patches, parasitically fed from the central patch, disposed around the central patch so as to form a cross, wherein the elemental groups are arranged in a plurality of parallel lines of groups, centers of adjacent groups along each parallel line being distanced by a distance P which is less than twice the resonant frequency wavelength $\lambda$, alternate ones of said parallel lines being displaced along a direction orthogonal to the parallel lines by P/2 so that the effective distance between centers of adjacent groups is less than $\lambda$.

13. An antenna according to claim 12 wherein P is at least equal to the resonant frequency wavelength $\lambda$.

14. An antenna according to claim 13 wherein adjacent lines of groups are distanced apart by P/2 so that the antenna comprises a square array.

15. An antenna according to claim 13, wherein the directly measured distance between the centers of groups in adjacent lines is less than the resonant frequency $\lambda$.

16. An antenna comprising:

a plurality of elemental groups disposed in an array upon a first substrate, each group having a central patch fed from a feed line and four parasitic patches parasitically fed from the central patch, disposed around the central patch so as to form a cross, wherein the elemental groups are arranged in a plurality of parallel lines of groups, centers of adjacent groups along each parallel line being distanced by a distance P which is less than twice the resonant frequency wavelength λ, alternate ones of said parallel lines being displaced along a direction parallel to the parallel lines by P2 so that the effective distance between centers of adjacent groups is less than λ, and a feed network having a plurality of feed lines disposed upon one face of a second substrate parallel with the first-mentioned substrate and aligned so that one of said feed lines lies adjacent a feed point of each central patch, and having a ground plane disposed between said substrates which ground plane includes an aperture between each said feed point and the adjacent respective one of said feed lines.

17. An array of microstrip antenna patches including both fed and parasitically fed patches, said array comprising:

an array of groups of patches disposed on the surface of a common substrate;

each said group including at least one transmission line fed patch and at least two parasitically fed patches that have edges spaced from edges of the transmission line fed patch by an interpatch spacing distance that is less than the intergroup spacing distance between the outside edges of adjacent groups of patches.

18. An array as in claim 17 wherein each group comprises:

a rectangular parasitically fed patch disposed in parallel proximity to each edge of a rectangular transmission line fed patch, which transmission line fed patch has a pair of opposing parallel sides L transverse to a pair of shorter opposing parallel sides W.

19. An array as in claim 18 wherein the interpatch spacing between the transmission line fed patch and the parasitically fed patches on two opposing parallel sides L is different than the interpatch spacing between the transmission line fed patch and the parasitically fed patches on the two remaining opposing parallel sides W.

20. An array as in claim 17 wherein the intergroup spacing is at least twice the interpatch spacing within a group.

21. An array as in claim 17 wherein the parasitically fed patches are of substantially rectangular shape and wherein the width of at least one parasitically fed patch within each group is different from that of another parasitically fed patch in the group.

22. An array as in claim 17 further comprising plural parallel RF microstrip feedlines coupled to said transmission line fed patches through apertures in a common ground plane disposed between a first dielectric substrate carrying all said patches and a second dielectric substrate carrying said feedlines.

23. An array as in claim 17 wherein said groups are arrayed in two orthogonal dimensions with center-to-center spacing of groups being greater than one wavelength at antenna operating frequencies in a first dimension and with center-to-center spacing of groups being less than said one wavelength in an orthogonal dimension.

24. An array as in claim 17 wherein said groups are arrayed in two orthogonal dimensions with center-to-center spacing of groups being less than one wavelength at antenna operating frequencies along both said orthogonal dimensions.

25. An antenna comprising:

a substrate;

a feedline;

a plurality of substantially rectangular patches arranged on a substrate in groups, the spacing between patches of adjacent groups exceeding the spacing between patches within a group, each group of patches including (a) a primary patch coupled to the feedline having a first pair of parallel edges and a second pair of parallel edges, said second pair of edges having a length defining a resonant antenna operating frequency, and (b) a pair of secondary patches, each secondary patch being adjacent to and spaced from one of the second pair of primary patch edges, whereby the secondary patches are parasitically fed from the primary patch while the groups of patches are spaced apart on the substrate in an array.

* * * * *